US009840349B2

(12) United States Patent
Marquis et al.

(10) Patent No.: US 9,840,349 B2
(45) **Date of Patent: *Dec. 12, 2017**

(54) PALLET SYSTEM FOR CABLE-ENABLED LOADING

(71) Applicant: M2 Concepts and Design LLC, Chiefland, FL (US)

(72) Inventors: Michael Marquis, Savannah, GA (US); Gary Marquis, Bell, FL (US)

(73) Assignee: M2 CONCEPTS AND DESIGN LLC, Savannah, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/203,849

(22) Filed: Jul. 7, 2016

(65) Prior Publication Data

US 2016/0311573 A1 Oct. 27, 2016

Related U.S. Application Data

(63) Continuation-in-part of application No. PCT/US2015/021705, filed on Mar. 20, 2015, which is a continuation of application No. 14/220,197, filed on Mar. 20, 2014, now Pat. No. 9,327,868.

(51) Int. Cl.

| | |
|---|---|
| ***B65D 19/02*** | (2006.01) |
| ***B65D 19/38*** | (2006.01) |
| ***B65D 19/00*** | (2006.01) |
| ***B65D 19/06*** | (2006.01) |

(Continued)

(52) U.S. Cl.

CPC ..... *B65D 19/02* (2013.01); *B65D 19/0002* (2013.01); *B65D 19/06* (2013.01); *B65D 19/36* (2013.01); *B65D 19/38* (2013.01); *B65D 21/0201* (2013.01); *B65D 2519/00268* (2013.01); *B65D 2519/00756* (2013.01); *B65D 2519/00776* (2013.01); *B65D 2519/00781* (2013.01)

(58) Field of Classification Search

CPC ..... B65D 19/06; B65D 19/36; B65D 19/02; B65D 19/38; B65D 21/0201; B65D 2519/00756; B65D 2519/00572; B65D 2519/00776; B65D 2519/00781; B65G 67/20

See application file for complete search history.

(56) References Cited

U.S. PATENT DOCUMENTS

| | | | |
|---|---|---|---|
| 2,444,183 A | 6/1948 | Cahners | |
| 2,665,020 A | 1/1954 | Whittle | |
| 2,728,454 A | 12/1955 | Hermitage | |

(Continued)

FOREIGN PATENT DOCUMENTS

| | | | |
|---|---|---|---|
| DE | 9202514 | 10/1992 | |
| DE | 102012004540 A1 * | 9/2013 | ..... B65G 67/20 |

(Continued)

*Primary Examiner* — Eret McNichols
(74) *Attorney, Agent, or Firm* — Sven W. Hanson

(57) ABSTRACT

A novel pallet construction and pallet moving system includes a rigid pallet including a linear conduit passing through the pallet between opposing sides of the pallet and open at the ends of the conduit. The conduit includes a removable lining to prevent destruction of the pallet and conduit during use. In alternative configurations, two offset conduits may be provided to accommodate other hardware and use constraints.

3 Claims, 7 Drawing Sheets

(51) Int. Cl.
*B65D 19/36* (2006.01)
*B65D 21/02* (2006.01)

(56) References Cited

U.S. PATENT DOCUMENTS

| | | | | |
|---|---|---|---|---|
| 2,783,011 | A | 2/1957 | Alexander | |
| 2,820,560 | A | 1/1958 | Davis | |
| 3,077,982 | A | 2/1963 | Bemer | |
| 3,199,765 | A | 8/1965 | Locke | |
| 3,392,800 | A | 7/1968 | Swamy | |
| 3,434,435 | A | 3/1969 | Achermann | |
| 3,464,371 | A | 9/1969 | Gifford | |
| 3,499,397 | A | 3/1970 | Johnson | |
| D219,582 | S | 12/1970 | Stout | |
| 3,567,068 | A | 3/1971 | Carfizzi | |
| 3,618,899 | A | 11/1971 | Hancock | |
| 3,796,279 | A | 3/1974 | Burdick | |
| 4,095,769 | A | 6/1978 | Fengels | |
| 4,203,697 | A | 5/1980 | Cayton | |
| D263,389 | S | 3/1982 | Nordstrom | |
| 4,397,246 | A | 8/1983 | Ishida | |
| 4,421,353 | A | 12/1983 | Smith | |
| 4,457,424 | A * | 7/1984 | Wuensch | B65G 67/24 108/53.1 |
| 4,694,962 | A | 9/1987 | Taub | |
| 4,792,325 | A | 12/1988 | Schmidtke | |
| 4,841,880 | A | 6/1989 | Ferguson | |
| 4,850,283 | A | 7/1989 | Carvin | |
| 4,863,024 | A | 9/1989 | Booth | |
| 4,867,074 | A | 9/1989 | Quasnick | |
| 4,890,560 | A | 1/1990 | Good | |
| 5,022,809 | A | 6/1991 | Hinson | |
| 5,069,143 | A | 12/1991 | Bunger | |
| 5,163,807 | A | 11/1992 | Gibson | |
| 5,226,373 | A | 7/1993 | Esch | |
| 5,333,555 | A | 8/1994 | McPhee | |
| 5,355,786 | A | 10/1994 | Tipton et al. | |
| 5,423,270 | A | 6/1995 | Kilpatrick | |
| 5,490,465 | A | 2/1996 | Hoyt et al. | |
| 5,546,872 | A | 8/1996 | Young | |
| 5,562,047 | A | 10/1996 | Forney et al. | |
| 5,836,254 | A | 11/1998 | Johansson | |
| 5,996,510 | A | 12/1999 | Harpman | |
| 6,135,030 | A | 10/2000 | Besaw | |
| 6,230,383 | B1 | 5/2001 | Welleman et al. | |
| 6,264,410 | B1 | 7/2001 | Keip et al. | |
| D450,906 | S | 11/2001 | Schepers | |
| 6,311,371 | B1 | 11/2001 | Dazzo | |
| 6,394,003 | B1 | 5/2002 | Lacy | |
| 7,637,219 | B2 | 12/2009 | Hartel | |
| 7,802,527 | B2 | 9/2010 | Dong | |
| 8,505,469 | B2 * | 8/2013 | Liu | B65D 19/001 108/50.11 |
| 2005/0076816 | A1 | 4/2005 | Nakano | |
| 2006/0060617 | A1 | 3/2006 | Facey et al. | |
| 2009/0308289 | A1 | 12/2009 | Ferguson | |
| 2010/0212982 | A1 | 8/2010 | Lin | |
| 2011/0168766 | A1 | 7/2011 | Erdie | |
| 2013/0145971 | A1 | 6/2013 | Federl | |
| 2015/0360811 | A1 | 12/2015 | Ness | |

FOREIGN PATENT DOCUMENTS

| | | | |
|---|---|---|---|
| DE | WO 2014111101 A1 * | 7/2014 | B65G 67/20 |
| EP | 1702864 | 9/2006 | |
| EP | 2230186 | 1/2013 | |
| FR | 3028247 A1 * | 5/2016 | B65D 19/0097 |
| NL | 9300608 | 11/1994 | |

* cited by examiner

PALLET SYSTEM FOR CABLE-ENABLED LOADING

BACKGROUND OF THE INVENTION

The present invention relates to pallets as structures for supporting, retaining and moving other objects. In general, a "pallet" as the term is used here refers to a rigid structure relatively planar with a thickness dimension substantially less than the orthogonal linear planar dimensions of the structure. The planar dimensions of a pallet may vary, but herein are considered typical pallet constructions with width and length planar dimensions in the range 48 inches to 110 inches. In no way are the above typical dimensions limiting of the aspects or utility of the present invention.

In general convention use and respecting the present invention, objects of value or interest otherwise are secured to one or more pallets. The pallets provide a means of aggregating multiple objects in some instances. A valuable aspect of pallets in most applications is their providing a means or mechanism for moving the secured objects without further contact with the objects. This may be valuable where the objects of interest are fragile or do not themselves provide convenient structural features for applying forces for moving them by conventional transport devices.

In many prior art applications, the transport device is in the form of a "forklift" which may be self-propelled or man-powered. Typically, the "fork" of the forklift is placed in a balanced position under the pallet, or within slots within the pallet body. In this manner, the forklift may be positioned under the center of gravity to enable winching the pallet with its load of objects.

In some applications, use of a forklift is not feasible. For example, in confined transport vehicles such as helicopters and other aircraft designed for cargo transport, in the past it has been necessary to move or position loaded pallets by man-power alone due to the unavailability, or the lack of clearance for the use, of forklifts. In some of these applications, it is possible to use cable winches to pull pallets into a transport vehicle space. For such applications, the pallets must be designed to survive the tension loads produced by such modes of movement which are not produced by simple lifting of the pallet from beneath—as with a forklift. A substantial difficulty exists with conventional prior use of a cable winch in the above manner. Where multiple pallets must be moved and positioned in a row, with the same orientation and closely spaced (which is almost always desirable), it is often impossible to access all of the pallets. Where the desired position of the pallets is in a longitudinally oriented row, it is usually possible to winch only the first pallet before access to the cable winch is blocked. In this arrangement, the first pallet and its secured object(s) block the needed path of the cable for each subsequent pallet in the row.

What is needed is a pallet that allows passage of a cable to access each subsequent pallet, aligned with the first pallet, to allow cable winching of multiple pallets.

SUMMARY OF THE INVENTION

The present invention includes a rigid pallet body including at least one linear conduit passing through the pallet between opposing sides of the pallet and open at the terminal ends of the conduit. The conduit includes a removable and replaceable liner to prevent destruction of the pallet and conduit during use. In particular configurations of the invention, two similar conduits are provided located symmetrically spaced from the pallet centerline.

The invention includes a system of two or more pallets including internal conduits with removable liners according to the invention. The system allows pallets to be moved and mutually located closely spaced by passing a cable through a first pallet and connecting to a subsequent pallet to draw the subsequent to the first. The invention includes methods of moving pallets in which pallets according to the invention are manipulated in the manner described.

Other novel aspects and advantages of the invention are illuminated by the specific embodiments detailed below, and by the accompanying drawing figures and the associated claims.

DETAILS OF EMBODIMENTS OF THE INVENTION

Figure 1:
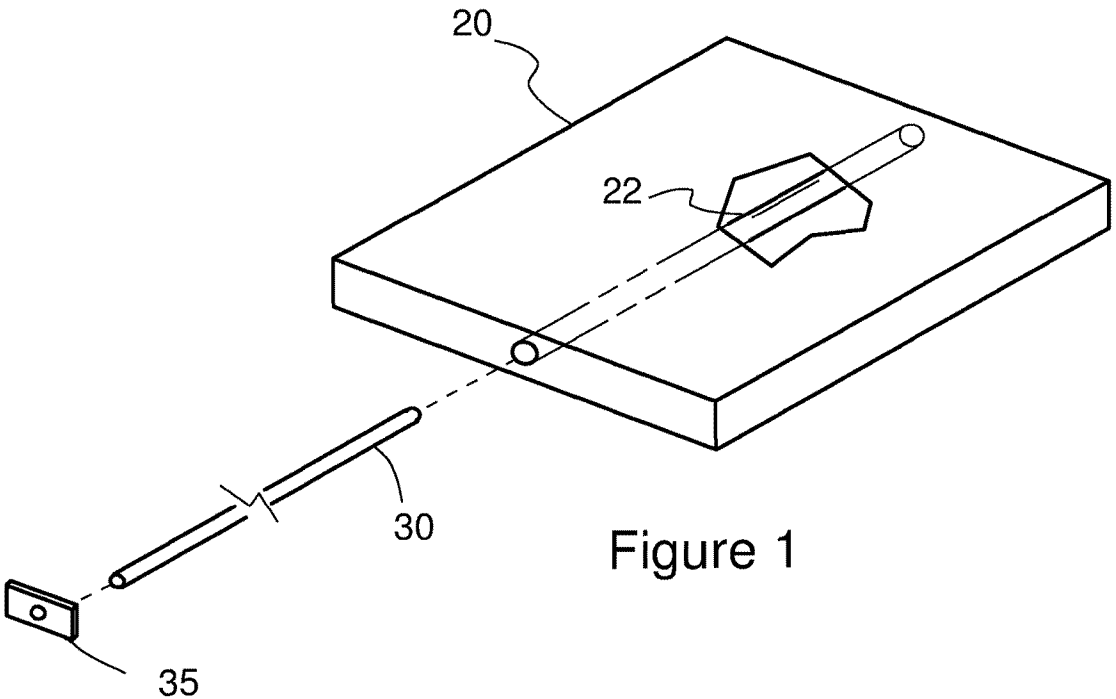
FIG. 1 is a perspective illustration of one configuration of the invention.
Figure 2:
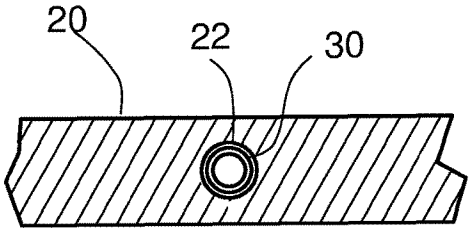
FIG. 2 is a detail section view from the configuration of FIG. 1.
Figure 3:
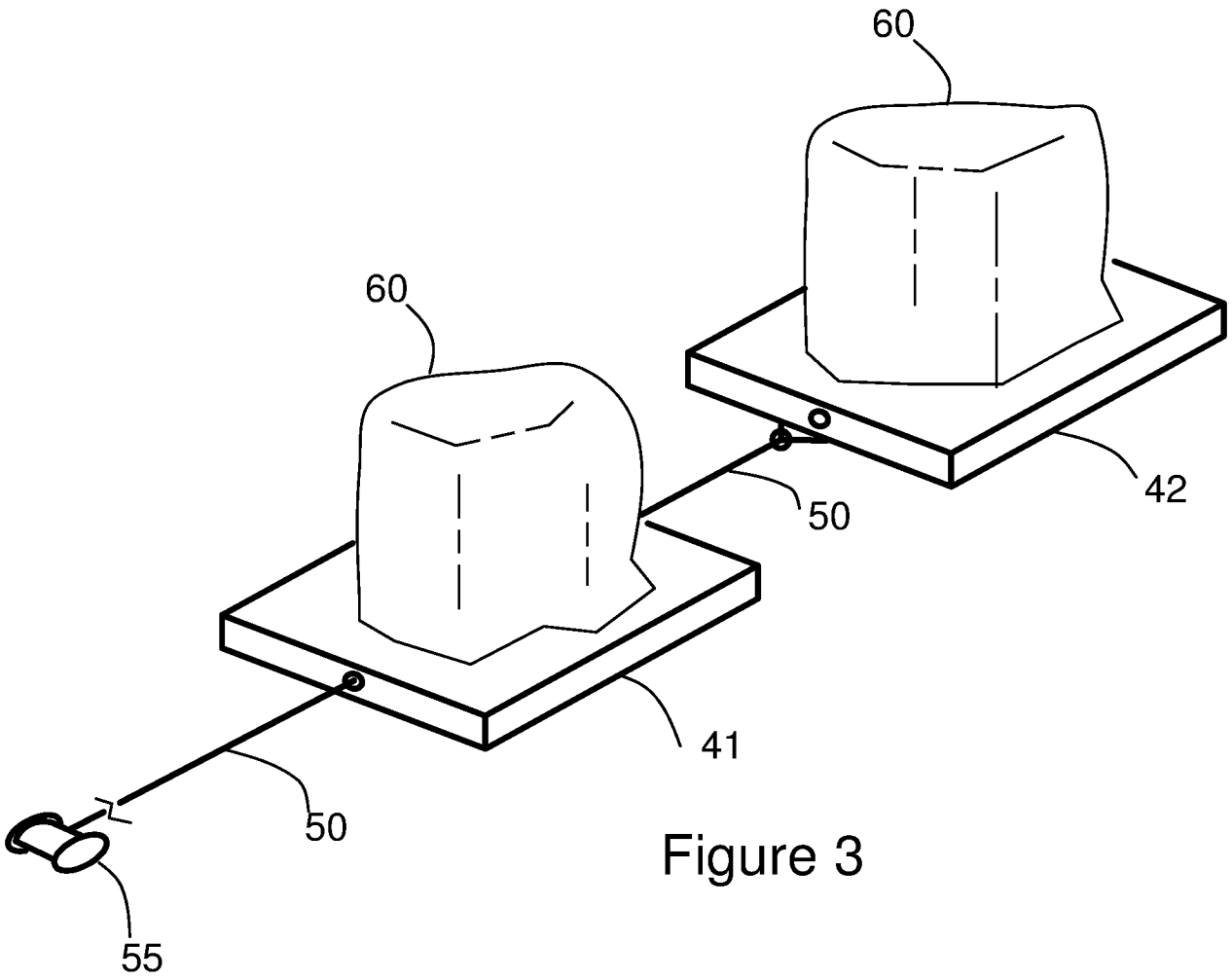
FIG. 3 is a perspective view of a system of pallets according to the invention.

FIGS. 1 and 2 regard a common configuration of the inventive pallet. FIG. 3 illustrates a system of pallets incorporating multiple pallets. The following discussion applies to all of the pallet constructions illustrated.

The inventive pallet includes a rigid pallet body 20 that is generally constructed similarly to conventional prior pallets. That is, the pallet body 20 is generally planar having a flat bottom to rest and slide on working surfaces such as storage buildings and transport vehicles. The upper surface of the pallet body 20 is most typically flat to accommodate supporting a wide variety of cargoes, although specialized shapes and constructions for securing and retaining particular cargoes may be used in the same way. The pallet body 20 is generally rigid relative to conventional cargoes and strong enough to resist distortion in operation. The materials and construction of the pallet body 20 may follow conventional constructions and applicable materials include wood, plastics and metals. The pallet body 20 may include other (not illustrated) features such as forklift slots for use of other associated devices and systems.

The inventive pallet includes a cable conduit 22 which is located within the pallet body 20, between the upper and lower surfaces, and extends fully between two opposing sides of the pallet body 20. Preferably, the conduit 22 is located symmetrically between the adjacent parallel sides of the pallet. The pallet body 20 in FIG. 1 is partially cut away to reveal the conduit 22 within. The conduit 22 is hollow and open at the opposing sides of the pallet body 20 to allow entry and exit of a cable through the conduit 22 and thereby effectively through the pallet body 20 at the same time.

The conduit 22 is preferably formed of aluminum tubing, although other rigid materials may be used, including steel and other metals. The conduit 22 must be substantially straight and unobstructed. The pallet body 20 and conduit 22 must be designed and assembled to provide rigid support of the conduit 22 within the pallet body 20. While the conduit 22 is not intended to sustain substantial forces in operation, use of the pallet itself may result in substantial distortion and upsetting forces and integrity of the conduit 22 within the pallet body 20 must be ensured.

An elongated hollow liner tube 30 is preferably formed of a solid rigid polytetrafluoroethylene (PTFE) extruded material. The material is selected for a combination of low friction and toughness against abrasion wear. Other Teflon (a registered trademark of the E. I. du Pont De Nemours and Company) containing materials and other materials having similar properties may be used. The liner tube 30 may also be a portion of, and carried by, a support structure such a metallic outer tube that would be removably located within the conduit 22 in the same manner. The liner tube 30 outside diameter is sized to be removably placed into the conduit 22. A slip fit is suggested. The length of the liner tube 30 should be sufficient to fully cover the inside surface of the conduit 22.

The function of the liner tube 30 is to allow easy passage and movement of a conventional steel winch cable through the conduit 22 while protecting the conduit 22 from wear and to prolong the life of the conduit 22 and pallet. For this reason, the liner tube 30 must be removable and replaceable after wear in use. The wall thickness of the liner tube 30 is not critical, although sufficient radial dimension to provide substantial use of life is desirable. A liner wall thickness dimension of ⅛ inch is suggested for this purpose.

After placing the liner tube 30 into the conduit 22, the liner tube 30 is captured and secured by a conduit cap 35 in the form of a flat rigid plate that is secured onto the side of the pallet body 20 by threaded fasteners or other attachment devices. The cap 35 includes a circular aperture having a diameter slightly smaller than the outer diameter of the liner tube 30 so that just the cap 35 overlaps a portion of the end section of the liner tube 30, leaving a portion exposed to indicate the level of wear over the use period of the liner tube 30. Other devices and mechanisms for securing the cap 35 are also contemplated and may be used for equal effect and result. Likewise, other mechanisms for temporarily securing the liner tube 30 within the conduit 22 may also be used. Such a mechanism may also be provided at the opposite end of the conduit 22 (opposing side of the pallet). Alternatively, one side of the conduit 22 may be sufficiently blocked to permanently prevent escape of the liner tube 30.

For most applications the conduit 22, with an installed liner tube 30, should have a finished inside diameter dimension of about 11/16 inches to accommodate a conventional winch cable with a terminal "eye". Larger conduit diameter dimensions will satisfy the functional requirements.

FIG. 3 illustrates how multiple matched pallets 41, 42 may be used in a system according to the invention to move and locate the pallets in a novel manner. In use, after the first matched pallet 41 is located, a winch cable 50 is passed through the conduit 22 of the pallet to reach the second matched pallet 42 to which the cable 50 is secured. The cable may be secured to the pallet in conventional manner. When an associated cable winch 55 is operated, the second pallet 42 may be dragged close to the first pallet 41.

Alternatively, the cable 50 may be passed also through the second pallet 42 to be secured to the backside of the second pallet 42 (not shown). In this way, when the cable tension is applied, the second pallet 42 is subjected to compression forces with less potential for distortion or destruction of the second pallet 42. The cable 50 serves as a flexible tension element and other materials typically used for this purpose and function may be substituted for similar affect and result.

Figure 4:
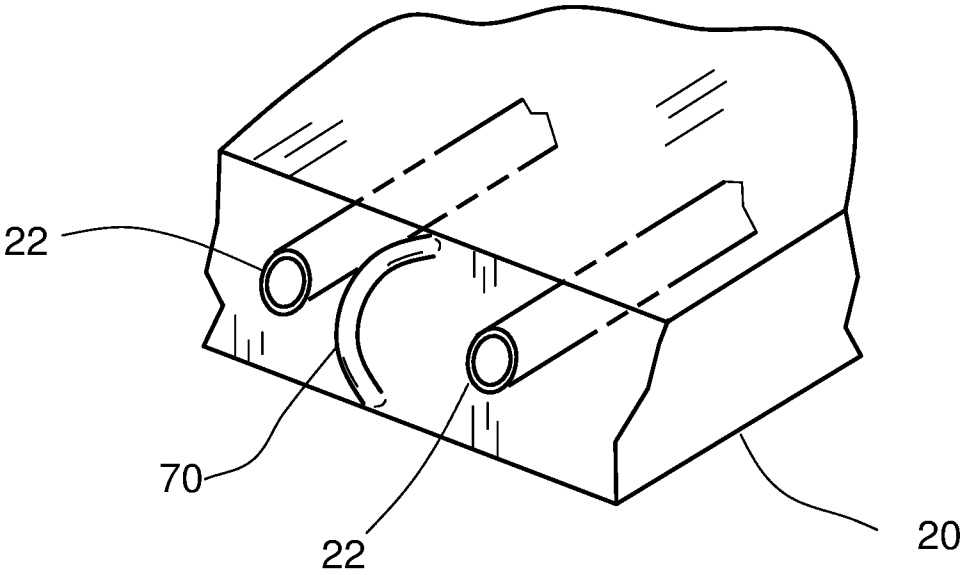
FIG. 4 is a perspective partial view of an alternative configuration of the inventive pallet.

FIG. 4 illustrates an alternative preferred configuration of a pallet according to the invention. It is often desirable to have a center-side located accessory device on a pallet. One example is a "D" ring that is often used to attach cables or other tension elements. Such an example accessory structure 70 is shown in FIG. 4 in the form of a D-ring. To accommodate this configuration or other similar incidental requirements, it may be desirable to include in the pallet two conduits 22, each located offset and parallel from the pallet horizontal centerline. This is shown in the figure. Slight offset will not detrimentally affect the performance of the pallet system described.

In a preferred configuration specifically adapted to existing helicopters used to transport pallet-supported materials, the pallet bodies each have overall width and length dimension of about 88 and 108 inches, respectively. Two conduits 22 are configured as discussed above, but are each located symmetrically spaced 14 inches from the pallet centerline. This spacing is used to advantage to match the particular relative location of winch equipment in the aircraft.

Figure 5:
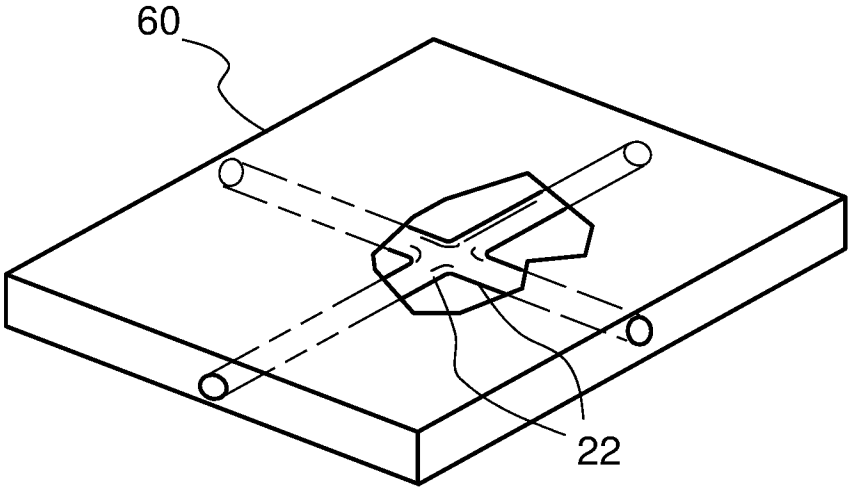
FIG. 5 is a perspective view of a further configuration of the inventive pallet.

FIG. 5 illustrates an alternative configuration of the inventive pallet. The pallet 60 includes two conduits 22, each conduit 22 following the design discussed above. The conduit liners and other details are not illustrated for clarity. Each of the conduits 22 traverses opposing sides of the pallet 60 and cross through each other at an intermediate point. The two conduits are essentially joined and may be parts of an integrated element. Each conduit 22 may be used independently from the other and the two together provide for flexibility of use of the pallet 60 for the methods provided herein. Alternatively where the thickness of the pallet allows, the two conduits may be independent and separate, crossing above and below each other at an intermediate point. For this purpose, each conduit 22 would be vertically offset in opposing directions—relatively up and down—to provide clearance. In the configuration shown, liners (not illustrated) may be provided for each conduit. To prevent interference between them, the liners may be formed of two portions separated at the point of crossing of the two conduits.

Figure 6A:
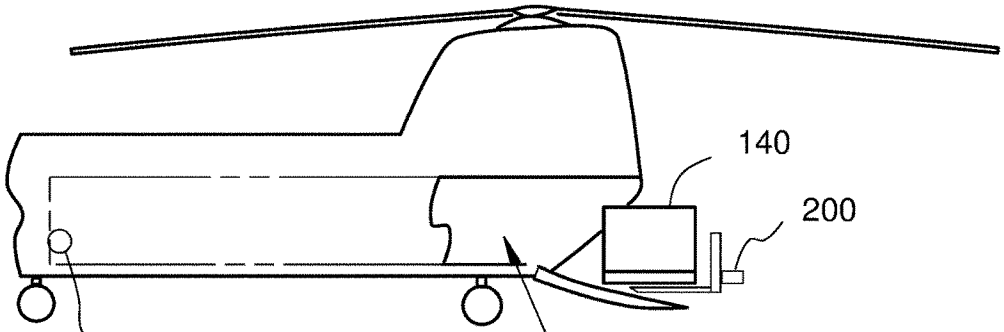
FIG. 6A, 6B and 6C are various side views of steps of operation of the inventive system methods using multiple pallets.
Figure 6B:
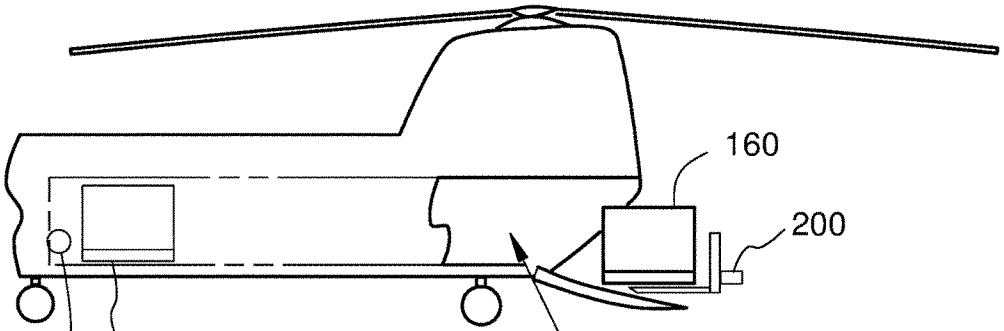
Figure 6C:
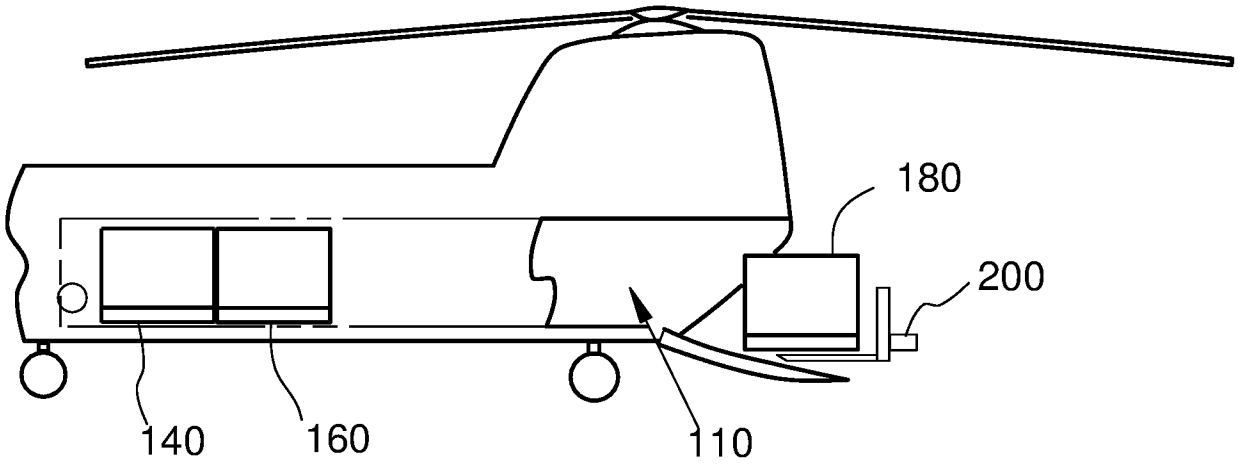

FIGS. 6A, 6B, and 6C illustrate use of the inventive pallet in the context of an illustrative vehicle into which palleted materials may be moved according to the inventive methods. The figures illustrate a rear portion a typical Chinook (Boeing CH-47) model helicopter. The helicopter in various conventional models has a deep horizontal cavity 110 and a winch 120 for moving palleted and unpalleted objects into the cavity 110. In a first step, a first pallet 140 is positioned at an open end of the cavity 110 (FIG. 6A). This is preferably accomplished by means of a conventional forklift 200 type equipment but this is not limiting. A winch cable (See FIG. 7) is extended from the winch and secured to the first pallet 140. The winch 120 is employed to drag the first pallet 140 into the cavity 110. The first pallet's 140 terminal position is illustrated in FIG. 6B.

In a second step, the winch cable is passed through the conduit of the first pallet 140 and extended to be secured to the second pallet 160. The second (and third and subsequent) pallet 160 is then moved into the cavity 110 in the same manner as the first pallet 140 as shown in FIG. 6B. To enable subsequent pallets, including the second pallet 160, to be moved as close as possible to the prior pallet, even to the point of contact between adjacent pallets, the winch cable is preferably passed through the conduit of the pallet to be moved and secured to the backside of the pallet. This is illustrated in FIG. 7.

Figure 7:
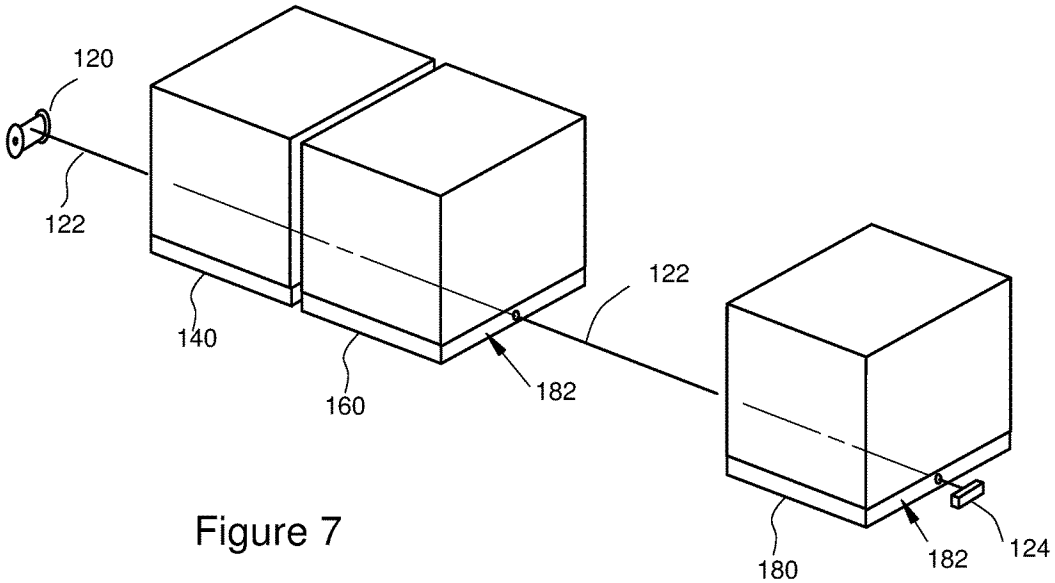
FIG. 7 is a perspective view of a configuration of three inventive pallets.

FIG. 7 illustrates a series of pallets 140, 160, 180 according to the invention. The pallets are illustrated combined with conventional pallet boxes located on the pallets, but the nature of the material supported by the pallets is not limiting. The details of the vehicle or space into which the pallets are being moved are not shown for clarity. However, the movement and use and manipulation of the pallets 140, 160, 180 initially may follow the discussion respecting FIGS. 6A, 6B and 6C. In the configuration shown, the first and second pallets 140, 160 have been moved into a stored position while the third pallet 180 is secured to the winch cable 122. The winch cable 122 passes through respective conduits (not illustrated in FIG. 7) in both the first and second pallets 140, 160 such that operation of the winch 120 and movement of the cable 122 is possible, and not impeded by the first and second pallets 140, 160. In this manner the third pallet 180 is drawn to a position adjacent the second pallet 160.

The cable 122 has been passed through the conduit of the third pallet 180 to be secured to the backside 182 of the third pallet 180 through use of a stop block 124. The function of the stop block 124 is to prevent the cable 122 from being drawn back through the pallet and to transfer the cable tension to the pallet backside 182.

After the third pallet 180 is drawn into position adjacent the second pallet 160, the cable is still accessible at the backside 182 of the third pallet 180. In this way, it should be clear that further subsequent pallets may be moved in the same manner, after the third pallet 180, by passing the cable 122 through a subsequent pallet and securing it to the respective backside.

Without securing the cable 122 to the backside of a pallet according to and enabled by the invention, it is not possible to position the pallet closely spaced to the previous pallet due to the lack, then, of access to the cable and it's securement to the pallet and the conduit.

The invention contemplates other equivalent materials and modes of construction that are known now or may be available in the future.

The invention claimed is:

1. A pallet system comprising:

a rigid planar body for supporting and transporting cargo;

at least one rigid hollow elongated tubular conduit extending entirely through the body;

a respective tubular liner disposed within each conduit, the liner being removable and replaceable; and each conduit including a respective rigid cap retaining the liner within the conduit.

2. A pallet, according to claim 1, and wherein:

the at least one conduit comprises two conduits, the conduits located spaced symmetrically from the pallet centerline.

3. A pallet, according to claim 1, and wherein:

the liner comprises a tube comprising polytetrafluoroethylene.

* * * * *